US009109772B2

(12) United States Patent
Brown

(10) Patent No.: US 9,109,772 B2
(45) Date of Patent: Aug. 18, 2015

(54) OPTICAL ELEMENT FOR A VEHICLE LIGHTING ASSEMBLY

(71) Applicant: FORD GLOBAL TECHNOLOGIES, LLC, Dearborn, MI (US)

(72) Inventor: David A. Brown, West Bloomfield, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 14/185,140

(22) Filed: Feb. 20, 2014

(65) Prior Publication Data

US 2014/0169001 A1 Jun. 19, 2014

Related U.S. Application Data

(62) Division of application No. 13/311,933, filed on Dec. 6, 2011, now Pat. No. 8,702,288.

(51) Int. Cl.
*F21V 5/00* (2015.01)
*F21S 8/10* (2006.01)

(52) U.S. Cl.
CPC ..... *F21S 48/1225* (2013.01); *F21S 48/215* (2013.01); *F21S 48/2212* (2013.01); *F21S 48/236* (2013.01)

(58) Field of Classification Search
CPC ... F21S 48/1258; F21S 48/00; F21S 48/1721; F21S 48/10; F21V 5/04; F21V 5/02
USPC ..... 362/520–522
See application file for complete search history.

(56) References Cited

U.S. PATENT DOCUMENTS

| | | | | |
|---|---|---|---|---|
| 4,577,260 | A * | 3/1986 | Tysoe | 362/521 |
| 5,833,355 | A * | 11/1998 | You et al. | 362/244 |
| 6,672,746 | B2 | 1/2004 | Amano | |
| 6,814,480 | B2 | 11/2004 | Amano | |
| 7,160,010 | B1 | 1/2007 | Chinniah et al. | |
| 8,292,480 | B2 | 10/2012 | Koizumi et al. | |
| 2005/0111114 | A1 | 5/2005 | Bode et al. | |
| 2006/0034094 | A1 | 2/2006 | Asada et al. | |
| 2010/0008088 | A1 | 1/2010 | Koizumi et al. | |

* cited by examiner

*Primary Examiner* — William Carter
(74) *Attorney, Agent, or Firm* — Frank MacKenzie; MacMillan, Sobanski & Todd, LLC

(57) ABSTRACT

A vehicle light assembly includes an array of light sources mounted in a generally planar base. An optical element includes a first surface having a first optical design and a second surface having second optical design. The second optical design includes a wedge having a first wedge wall and a second wedge wall that converges with the first wedge wall. The second wedge wall extends at an angle to the first wedge wall. A bezel surrounds the base and the optical element, and an outer lens is positioned adjacent the outside surface of the optical element. The optical element is between the base and the outer lens, and the outer lens has an inner surface including an optical design.

19 Claims, 4 Drawing Sheets

OPTICAL ELEMENT FOR A VEHICLE LIGHTING ASSEMBLY

CROSS REFERENCE TO RELATED APPLICATIONS

This is a divisional application of U.S. application Ser. No. 13/311,933, filed Dec. 6, 2011, which is incorporated herein by reference.

BACKGROUND OF THE INVENTION

This invention relates in general to vehicle lighting assemblies. In particular, this invention related to an improved optical element for use in such a vehicle lighting assembly.

Known lighting assemblies, particularly those used in automotive vehicles, frequently include one or more optical elements to collect and distribute light from a light source, such as a bulb or a light emitting diode (LED). Such optical elements can include reflectors, light guides, and lens designs that collect and distribute light from the light source to achieve maximum efficiency and even diffusion of light across a broad area. For example, Fresnel lenses have been used in vehicle tail and stop light assemblies.

Uniquely shaped lighting assemblies, particularly as used in vehicles, give rise to challenges in creating a uniform radiance array. While known systems have included refinements that enhance lamp efficiency, further improvements are desirable to achieve even higher efficiency and a more even distribution of light.

SUMMARY OF THE INVENTION

This invention relates to an improved optical element for use in a vehicle lighting assembly. The optical element includes a first surface having a first optical design and a second surface having second optical design. The second optical design includes a wedge including a first wedge wall and a second wedge wall that converges with the first wedge wall. The second wedge wall extends at an angle relative to the first wedge wall.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
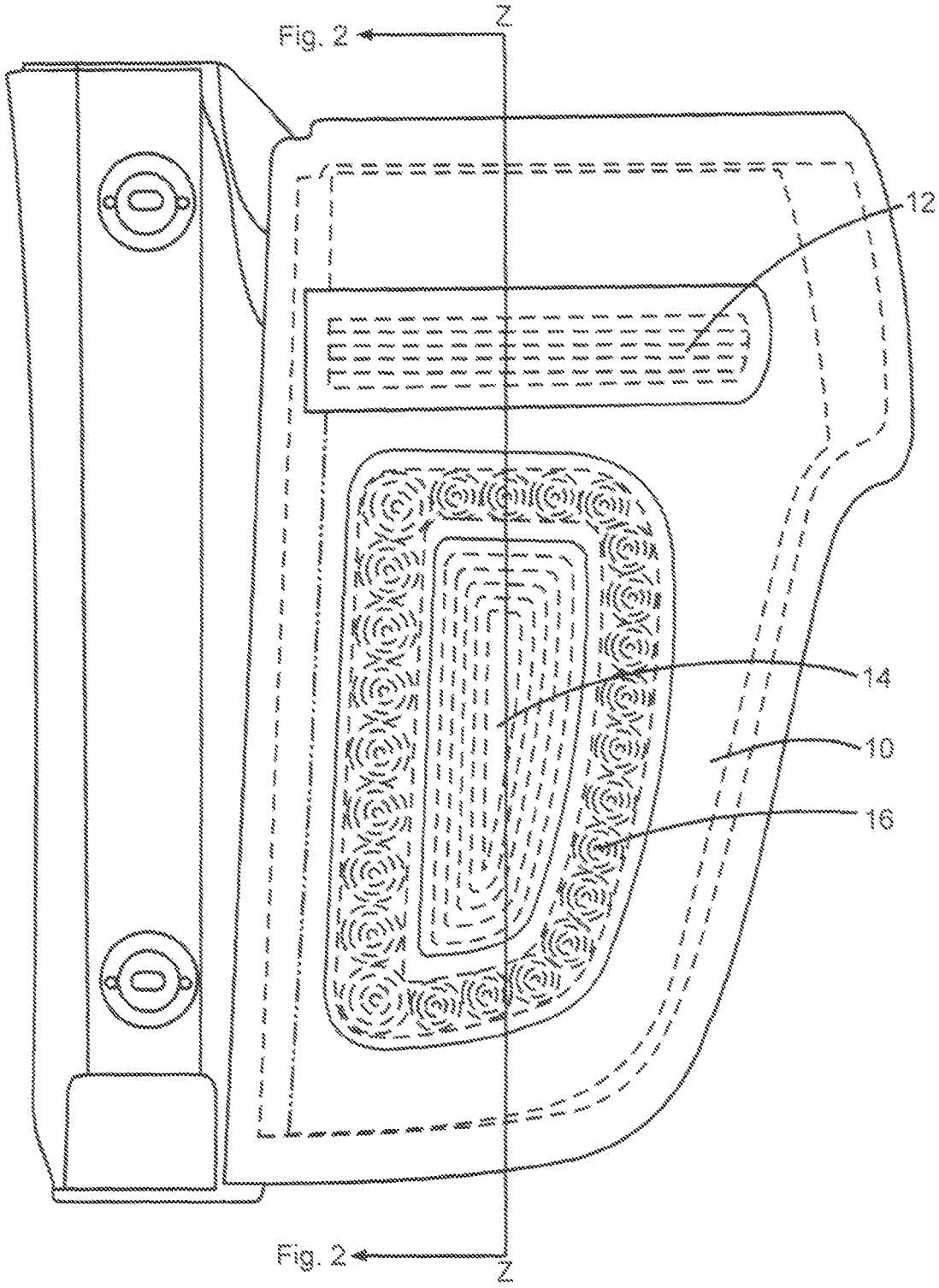
FIG. 1 is a front elevational view of a vehicle lighting assembly in accordance with this invention.

Referring to the drawings, there is illustrated in FIG. 1 a lighting assembly 10 that can, for example, mounted on a right rear portion of a vehicle. The lighting assembly 10 includes a backup light 12 and a turn signal light 14, both of which are conventional in the art. The lighting assembly 10 also includes a generally D-shaped light 16 in accordance with this invention. The generally D-shaped light 16 can function as both a position and/or tail light, as well as a stop light function for the vehicle, although such is not required. In the illustrated embodiment, the generally D-shaped light 16 is located below the backup light 12, and the turn signal light 14 is located within the interior of the generally D-shaped light 16. The generally D-shaped light 16 is preferably consistent with worldwide motor vehicle standards and provides optimum visibility and appealing aesthetics. However, the lighting assembly 10 may have any other desired configuration.

Figure 2:
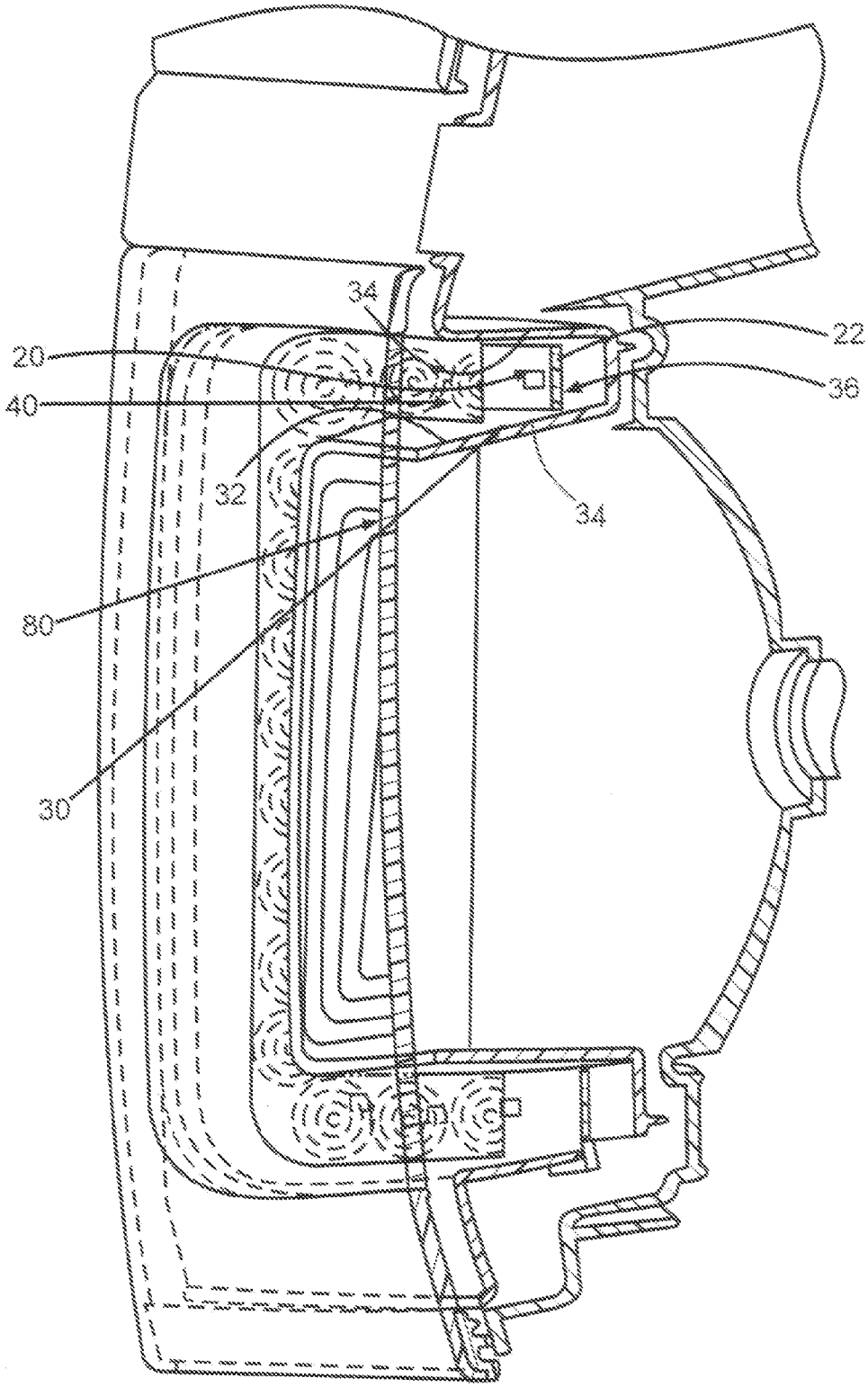
FIG. 2 is a sectional elevational view taken along line 2-2 of FIG. 1.

As shown in FIG. 2, the generally D-shaped light 16 is formed from an array of individual light sources. In the illustrated embodiment, the generally D-shaped light 16 is formed from twenty-four light emitting diodes (LEDs) 20 (only one is illustrated) that are arranged in a generally D-shaped array. The LEDs 20 may be equally spaced throughout the illustrated D-shaped array, although such is not required. The illustrated LEDs 20 are mounted perpendicularly on an LED base 22 and are powered from a power source (not shown) in a manner that is well known in the art. The LEDs 20 are supported on the LED base 22 so as to lie in a single plane, although such is not required. The LED base 22 may, if desired, be slightly tilted relative to a vertical axis Z-Z (see FIG. 1) defined by the vehicle. The optical design of this invention is provided to insure that adequate light is directed from the LEDs 20 toward the center of the vehicle, as will be discussed below.

A reflective collection bezel 30 surrounds the LED base 22 and each of the LEDs 20 supported thereon. Although any desired material can be used, the reflective collection bezel 30 is preferably formed from a high heat-resistant polycarbonate material that has a roughened inner micro-grain surface 32 (formed by sand blasting, for example). The polycarbonate inner surface may be provided with a thin aluminum coating to create a chrome-like mirror surface, which may be use to reflect light rays from the LEDs 20, as is well known in the art. The reflective collection bezel 30 may also be generally D-shaped, similar to that of the generally D-shaped LED base 22. As shown in FIG. 2, the reflective collection bezel 30 has a generally reverse-C cross sectional shape that surrounds both the LEDs 20 and the LED base 22, with legs 34 of the reflective collection bezel 30 tapering outwardly away from the LEDs 20 in a wedge-like manner.

The lighting assembly 10 also includes an inner optical element 40. The illustrated inner optical element 40 is generally D-shaped and is attached to the LED base 22 and the reflective collection bezel 30 to form an optical plate/LED subassembly 36. The inner optical element 40 may be formed from any desired material, such as a high heat resistant polycarbonate material. The inner optical element 40 is preferably spaced from the LEDs 20 by a distance that provides an optimum focal point for light rays emitted therefrom. Of course, this optimum distance may vary with the specific design and purpose of the lighting assembly 10. The optical plate/LED subassembly 36 can includes a plurality of tabs 38 (see FIG. 3) that pass through respective slots (not shown) formed through the LED base 22 and snap into slots (not shown) in the reflective collection bezel 30 to position and hold retain the components together and thereby form the optical plate/LED subassembly 36.

Figure 6:
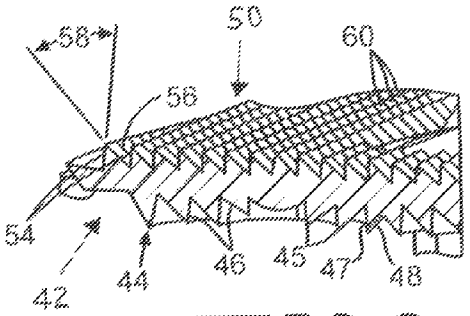
FIG. 6 is a sectional perspective view taken along line 6-6 of FIG. 5.
Figure 3:
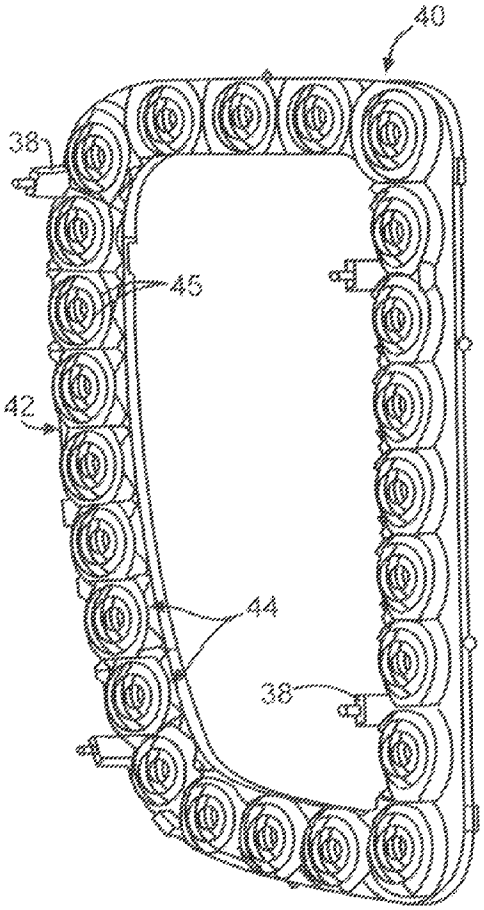
FIG. 3 is a perspective view of an inner surface of an inner optical element of the vehicle lighting assembly illustrated in FIGS. 1 and 2.

Referring to FIGS. 3 and 6, an inner surface 42 of the inner optical element 40 (i.e., the surface facing the front of the vehicle) is shown as having a plurality of light diffusion patterns 44 provided thereon. In the illustrated embodiment, the inner surface 42 of the inner optical element 40 is provided with twenty-four of such light diffusion patterns 44, one for each of the twenty-four LEDs. Each of the illustrated light diffusion patterns 44 overlaps or intersects with the adjacent light diffusion patterns 44, although such is not required. Each of the illustrated light diffusion patterns 44 may, for example, be Fresnel patterns. Each of the illustrated light diffusion patterns 44 may include four concentric circular rings 45 that are defined by generally V-shaped grooves 46, although again such is not required. The outermost ring 45 in each of the illustrated light diffusion patterns 44 can, for example, be about 20 mm in diameter, and each of the successively inner rings 45 can be equally spaced form the adjacent ring 45 by about 2.5 mm. Of course, the size and dimensions of the light diffusion patterns 44 may vary in accordance with the particular application.

As best shown in FIG. 6, each of the grooves 46 includes a generally cylindrical first wall 47 that, in the illustrated embodiment, extends generally perpendicularly to the inner surface 42 of the inner optical element 40. Each of the grooves 46 also includes a generally frusto-conical second wall 48 that, in the illustrated embodiment, extends at an angle relative to the first wall 47. The depth of each of the grooves 46 may, for example, be about 1.75 mm. The inner walls 48 of each of the grooves 46 may be concavely shaped, although such is not required. The light diffusion patterns 44, together with other elements of the lighting assembly 10, function to provide optimum light distribution.

Figure 5:
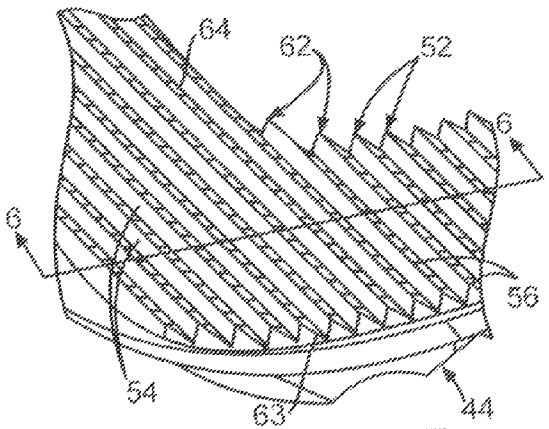
FIG. 5 is an enlarged perspective view of a portion (indicated as region "A") of the outer surface of the inner optical element illustrated in FIG. 4.
Figure 4:
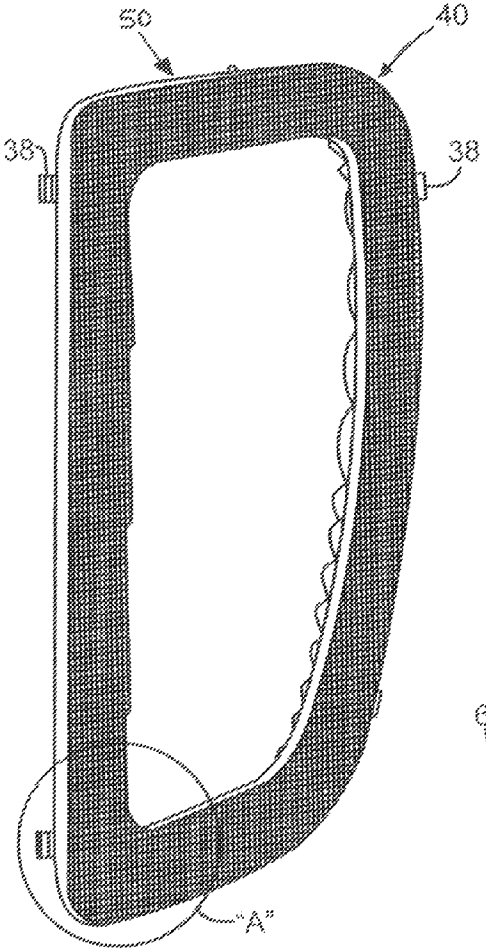
FIG. 4 is a perspective view of an outer surface of the inner optical element of the vehicle lighting assembly illustrated in FIGS. 1, 2, and 3.

Referring to FIGS. 4, 5, and 6, an outer surface 50 of the inner optical element 40 includes a plurality of generally parallel wedges 52 that extend over the entire outer surface 50 to create a saw tooth pattern. Each of the wedges 52 may have a height of approximately 1.5 mm, and adjacent ones of the wedges 52 may be spaced apart about 2 mm. The overall thickness of the inner optical element 40, as measured from the tips of the light diffusion patterns 44 provided on the inner surface 42 to the tips of the wedges 52 provided on the outer surface 50, can be about 6 mm. Each of the wedges 52 can include a first wall 54 that extends generally perpendicularly to the outer surface 50 of the inner optical element 40 and, therefore, to the LED base 22. Each of the wedges 52 can further include a second wall 56 that extends at an angle 58 (see FIG. 6) of about forty-five degrees from the first wall 54. Some of the light rays passing through the angled wall 56 will be directed toward the center of the vehicle to compensate for the slight tilting of the LED base 22 away from the center of the vehicle to optimize performance of the lighting assembly 10. Factors that will determine the specifics of the outer surface 50 of the inner optical element 40 can include, among other things, the distance of the inner optical element from the LED and the specific shapes of the light diffusion patterns 44 on the inner surface 42, as will be understood by those skilled in the art.

As best shown in FIG. 5, each of the illustrated first and second walls 54 and 56 of the wedges 52 is generally planar, although such is not required. However, as shown in FIG. 6, it can be seen that the second walls 56 of each of the wedges 52 may include spaced-apart micro-flutes 60. The illustrated micro-flutes 60 are each generally semi-cylindrical in shape, having a radius of about 7.5 mm, a depth of about 0.015 mm, and a width of about 2.5 mm. Of course, the shape, depth and spacing of the micro-flutes 60 may vary depending on the application. For example, the micro-flutes 60 can have radii in the range from about 2 mm to about 20 mm, depths in the range from about 5 mm to about 50 mm, and widths in the range from about 1 mm to about 5 mm depending upon the specific application.

The angled walls 56 of each of the wedges 50 converge with the wall 54 at wedge tips 62. The micro-flutes 60 of each of the angled walls 56 create a scalloped design 64 at the tips 62. The tips 62 of each wedge 52 are convex to promote light ray distribution. The radius of convexity of the tips 62 is preferably relatively small so as to create a relatively sharp edge. The bottom of each wedge 52 is defined by a similarly shaped scalloped groove 63.

The inner optical element 40 can be formed by injection molding or any other desired process. Electric discharge machining, also called EDM burning, can be used to make the tooling to mold the inner optical element 40 because of the intricate details of the micro-flutes 60. The micro-flutes 60 and the scalloped design 64 of the wedge tips 62, together with the light diffusion patterns 44 and the other elements of the lighting assembly 10, provide optimum light distribution to achieve a harmonious and even light distribution.

Light from the LEDs 20 passing through the inner optical element 40 is first generally collimated by the light diffusion patterns 44, and then more finely diffused by the wedges 52, which have the unique micro-fluted walls 54 and 56 and scalloped wedge tips 64. Some light passing through the inner optical element 40 is bent inwardly toward the center of the vehicle by the wedges 52, and more evenly disbursed by the micro-flutes 60.

Figure 7:
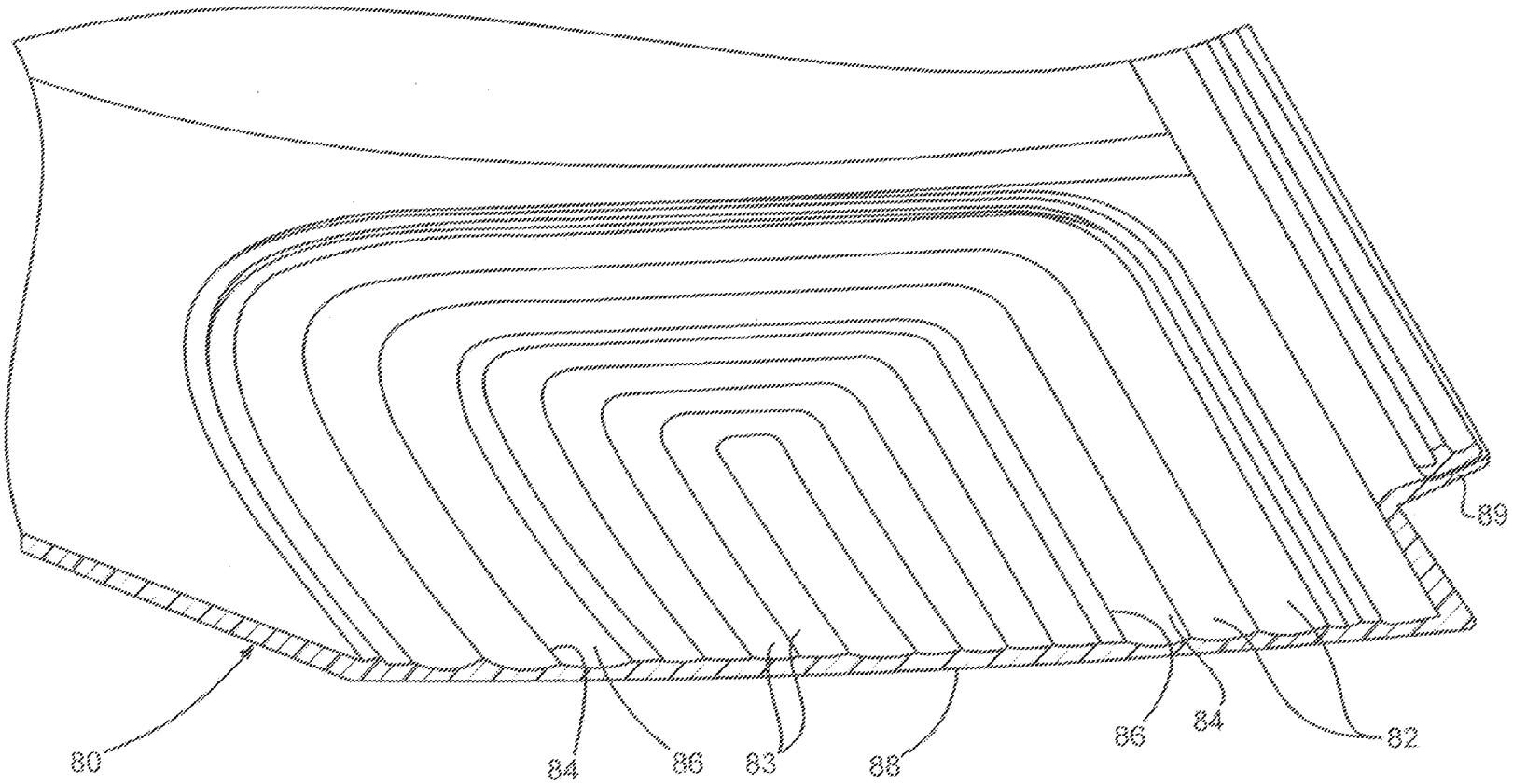
FIG. 7 is a perspective view, partially in cross section, of an inner surface of an outer lens of the vehicle lighting assembly of FIG. 1.

As shown in FIGS. 2 and 7, the lighting assembly 10 further includes an acrylic outer lens 80 that covers the outer surface of the generally D-shaped light 16 and conforms to the shape of the vehicle. The inner surface of outer lens 80 includes a series of generally concentric D-shaped flutes 82. The flutes 82 may, for example, be approximately one 1 mm deep and spaced apart approximately 11 mm in the area covering the inner optical element 40. The flutes 83 aligned with the turn signal light 14 at the interior of the inner optical element 40 are more narrow and shallow. Concave outer walls 84 and inner walls 86 define each flute 82. The outer surface 88 of the outer lens 80 is relatively smooth for pleasing aesthetics. A seal 89 extends around the outer periphery of the lens 80. The combination of the unique outer lens 80 with the unique inner optical element 40 provides three light refraction surfaces, which optimize effeminacy and light ray distribution.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An optical element for vehicle exterior light distribution, comprising:

a first surface facing a light source and having a first optical design including a light diffusion pattern; and a second surface facing outwardly from the vehicle and having second optical design, the second optical design including a wedge design, the wedge design including a first wedge wall and a second wedge wall converging with the first wedge wall, the second wedge wall extending at an angle to the first wedge wall, wherein at least one of said first and second wedge walls includes micro-flutes.

2. An optical element as defined in claim 1 wherein the optical element is a lens.

3. An optical element as defined in claim 1 wherein the wedge design includes a series of parallel wedges, and wherein each wedge includes a first wedge wall and a second wedge wall converging with the first wedge wall and extending at an angle to the first wedge wall, and wherein at least one of the first and second wedge walls of each wedge defines micro flutes.

4. An optical element as defined in claim 3 wherein the first and second surfaces are opposed to each other, and wherein the first and second wedge walls of each wedge converge in a direction toward the first surface, and wherein the first and second wedge walls of next adjacent wedges converge in a direction away from the first surface to form edges, whereby the wedge walls have a saw tooth configuration.

5. An optical element as defined in claim 4 wherein each micro flute extends the full axial length of the wedge walls.

6. An optical element as defined in claim 5 wherein each micro flute is scalloped, whereby the edges of the wedge walls have a scalloped configuration.

7. An optical element as defined in claim 6 wherein each micro flute is semi-cylindrical.

8. An optical element as defined in claim 7 wherein each of the second wedge walls extend at an oblique angle to the first walls.

9. An optical element as defined in claim 5 wherein each micro flute is scalloped, whereby the edges of the wedge walls have a scalloped configuration.

10. An optical element as defined in claim 1 wherein the first wedge wall extends generally perpendicular to the second surface, and wherein the second wedge wall includes micro flutes.

11. An optical element as defined in claim 10 wherein the tip of the wedge has a scalloped configuration.

12. An optical element as defined in claim 1 wherein the first and second optical element surfaces are generally parallel to each other, and wherein the first wedge wall extends generally perpendicular to the optical element surfaces.

13. An optical element as defined in claim 12 wherein the angle between the first and second wedge walls is about 45 degrees.

14. An optical element as defined in claim 1 wherein the micro flutes have a depth of about fifteen thousandths (0.015) millimeters.

15. An optical element as defined in claim 14 wherein the height of the first wedge wall is about one and one-half (1.5) millimeters.

16. An optical element as defined in claim 14 wherein the flutes are semi-cylindrical with a radius of about seven and one-half (7.5) millimeters.

17. An optical element as defined in claim 16 wherein the flutes have a width of about two (2) millimeters.

18. An optical element as defined in claim 1 wherein the optical design of the first surface includes a first Fresnel pattern.

19. An optical element for vehicle exterior light distribution, comprising: first and second opposed surfaces, the first surface facing a light source and having a first optical design including a light diffusion pattern, the second surface facing outwardly from the vehicle and having a second optical design, the second optical design including a wedge design, the wedge design including a first wedge wall extending generally perpendicularly to the second surface and a second wedge wall converging with the first wedge wall, the second wedge wall extending at a oblique angle to the first wedge wall, the second wedge wall including semi-cylindrical micro-flutes extending the width of the second wall, each micro-flute edge defining an edge of two adjacent micro flutes, whereby the second surface is completely covered with micro-flutes, whereby light passing through the device in a direction substantially perpendicular to the second surface will pass through a micro flute.

* * * * *